US010978804B2

(12) United States Patent
Haarakangas

(10) Patent No.: US 10,978,804 B2
(45) Date of Patent: Apr. 13, 2021

(54) QUADRIFILAR HELICAL ANTENNA FOR COMMUNICATING IN A PLURALITY OF DIFFERENT FREQUENCY BANDS

(71) Applicant: BITTIUM WIRELESS OY, Oulu (FI)

(72) Inventor: Tuomo Haarakangas, Oulu (FI)

(73) Assignee: BITTIUM WIRELESS OY, Oulu (FI)

( * ) Notice: Subject to any disclaimer, the term of this patent is extended or adjusted under 35 U.S.C. 154(b) by 98 days.

(21) Appl. No.: 16/490,246

(22) PCT Filed: Mar. 17, 2017

(86) PCT No.: PCT/FI2017/050178
§ 371 (c)(1),
(2) Date: Aug. 30, 2019

(87) PCT Pub. No.: WO2018/167353
PCT Pub. Date: Sep. 20, 2018

(65) Prior Publication Data

US 2020/0067194 A1 Feb. 27, 2020

(51) Int. Cl.
*H01Q 11/08* (2006.01)
*H01Q 5/307* (2015.01)

(52) U.S. Cl.
CPC ..... *H01Q 11/08* (2013.01); *H01Q 5/307* (2015.01)

(58) Field of Classification Search
CPC ..... H01Q 1/36; H01Q 1/362; H01Q 11/04; H01Q 11/08; H01Q 11/083; H01Q 21/24;
(Continued)

(56) References Cited

U.S. PATENT DOCUMENTS 4,008,479 A * 2/1977 Smith ..... H01Q 1/362 343/895
5,349,365 A * 9/1994 Ow ..... H01Q 11/08 333/26

(Continued)

FOREIGN PATENT DOCUMENTS

JP 11-225015 8/1999
WO 99/33146 7/1999

(Continued)

OTHER PUBLICATIONS

Yongle Wu, et al., "A Frequency-Independent Dual-Band Printed Quadrifilar Helix Antenna Using Nonuniform, Unequal-Length, Asymmetrical Coupled Lines", Microwave and Optical Technology Letters, Jul. 2016, vol. 58, No. 7, pp. 1728-1733.

(Continued)

*Primary Examiner* — Jason Crawford
(74) *Attorney, Agent, or Firm* — Nixon & Vanderhye P.C.

(57) ABSTRACT

A quadrifilar helical antenna for communicating in a plurality of different frequency bands comprises at least two ports. Each port is operationally coupled with a port-specific set of helical filars, the port-specific set of filars including at least one band-specific filar for each of said plurality of the different frequency bands. At least two of the band-specific filars, the band-specific filars belonging to different band-specific filars and different port-specific sets adjacent to each other, have mutual coupling between the ports, the mutual coupling resulting in a destructive phasing of the frequency bands between the at least two of the band-specific filars.

6 Claims, 3 Drawing Sheets

(58) Field of Classification Search
CPC ..... H01Q 21/245; H01Q 21/29; H01Q 5/30; H01Q 5/307; H01Q 5/314; H01Q 5/328; H01Q 5/335; H01Q 5/35; H01Q 9/27; H01Q 9/28; H01Q 9/44
See application file for complete search history.

(56) References Cited

U.S. PATENT DOCUMENTS

| | | | | |
|---|---|---|---|---|
| 5,828,348 | A * | 10/1998 | Tassoudji | H01Q 11/08 343/895 |
| 5,909,196 | A * | 6/1999 | O'Neill, Jr. | H01Q 1/242 343/853 |
| 6,072,441 | A * | 6/2000 | Tanabe | H01Q 1/38 343/895 |
| 6,184,844 | B1 * | 2/2001 | Filipovic | H01Q 5/40 343/895 |
| 6,421,028 | B1 * | 7/2002 | Ohgren | H01Q 11/08 343/850 |
| 6,424,316 | B1 * | 7/2002 | Leisten | H01Q 1/242 343/895 |
| 6,653,987 | B1 * | 11/2003 | Lamensdorf | H01Q 1/38 343/853 |
| 7,158,093 | B2 * | 1/2007 | Yang | H01Q 1/362 343/895 |
| 10,700,430 | B1 * | 6/2020 | Abbasi | H01Q 3/40 |
| 2008/0122733 | A1 * | 5/2008 | O'Neill | H01Q 11/08 343/895 |
| 2010/0013735 | A1 * | 1/2010 | Munger | H01Q 11/08 343/895 |
| 2011/0001684 | A1 * | 1/2011 | Haarakangas | H01Q 1/362 343/895 |
| 2011/0254755 | A1 * | 10/2011 | DiNallo | H01Q 11/08 343/893 |
| 2018/0090829 | A1 * | 3/2018 | Mcmichael | H01Q 9/145 |
| 2018/0198194 | A1 * | 7/2018 | Hyjazie | H01Q 11/08 |

FOREIGN PATENT DOCUMENTS

| | | |
|---|---|---|
| WO | 99/60665 | 11/1999 |
| WO | 00/77951 | 12/2000 |
| WO | 2011/001006 | 1/2011 |

OTHER PUBLICATIONS

International Preliminary Report on Patentability for PCT/FI2017/050178 dated May 13, 2019, 21 pages.
International Search Report for PCT/FI2017/050178 dated Aug. 21, 2017, 4 pages.
Written Opinion of the ISA for PCT/FI2017/050178 dated Aug. 21, 2017, 8 pages.
Office Action issued in GB Appln. No. 1915053.1 dated Nov. 14, 2019.

* cited by examiner

QUADRIFILAR HELICAL ANTENNA FOR COMMUNICATING IN A PLURALITY OF DIFFERENT FREQUENCY BANDS

This application is the U.S. national phase of International Application No. PCT/FI2017/050178 filed Mar. 17, 2017, the entire content of which is hereby incorporated by reference.

FIELD

The invention relates to a quadrifilar helical antenna for communicating in a plurality of different frequency bands.

BACKGROUND

Multifilar helical antennas are usually made for a specific, relatively narrow frequency band or bands. Traditionally dualband quadrifilar helical antenna has two filars per port, one for each operation band to enable the dual band operation. Quadrifilar helical antennas and particularly the small ones have limited efficiency and bandwidth in dual/multiband operation. Hence, there is a need to improve the multifilar antennas for overcoming the interference.

BRIEF DESCRIPTION

The present invention seeks to provide an improvement for the multiband quadrifilar helical antennas. According to an aspect of the present invention, there is provided a helical antenna for communicating in a plurality of different frequency bands as specified in the independent claim.

The invention has advantages. Several frequency bands can be communicated with the filars of a common helical antenna on the basis of a mutual coupling between the filars of different frequency bands.

LIST OF DRAWINGS

Example embodiments of the present invention are described below, by way of example only, with reference to the accompanying drawings, in which FIG. 1 illustrates an example of a helical antenna which has two ports and a mutual coupling between the ports;

DESCRIPTION OF EMBODIMENTS

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

It should be noted that while Figures illustrate various embodiments, they are simplified diagrams that only show some structures and/or functional entities. The connections shown in the Figures may refer to logical or physical connections. It is apparent to a person skilled in the art that the described apparatus may also comprise other functions and structures than those described in Figures and text. It should be appreciated that details of some functions, structures, and the signalling used for measurement and/or controlling are irrelevant to the actual invention. Therefore, they need not be discussed in more detail here.

Figure 1:
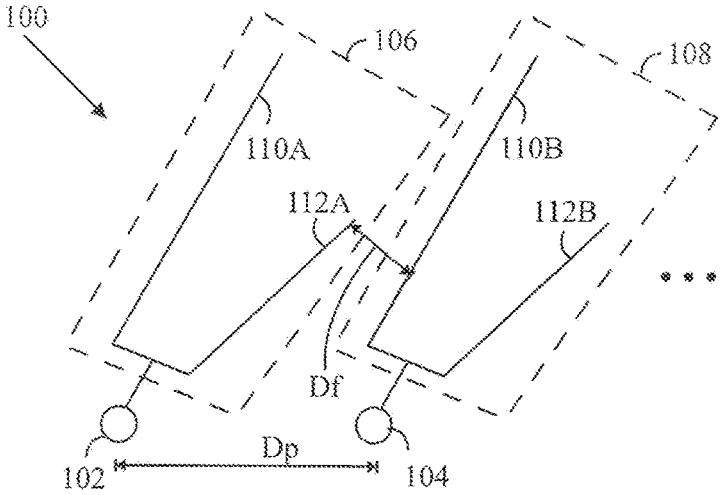

FIG. 1 illustrates an example of a quadrifilar helical antenna which is meant for or capable of communicating in a plurality of different radio frequency bands of electromagnetic radiation. The antenna may transmit, receive or both transmit and receive. The frequency bands may be partially but not fully overlapping or totally separate bands such that no single frequency is common to any two of the plurality of the bands. The plurality of the different bands refers to at least two bands. The quadrifilar helical antenna 100 comprises at least two ports 102, 104.

Each port 102, 104 is operationally coupled with a port-specific set 106, 108 of helical filars. The port-specific set 106 of filars include at least one band-specific filar 110A, 112A for each of said plurality of the different frequency bands. In the example of FIG. 1, there are only two bands in use. Thus, the filar 110A is for one frequency band and the filar 112A is for another frequency band. Correspondingly, the port-specific set 108 of filars include one band-specific filar 110B, 112B for each of said plurality of the different frequency bands such that the filar 110B is for one frequency band and the filar 112B is for another frequency band. The frequency band-specific filars 110A and 110B are for a common frequency band. Correspondingly, the frequency band-specific filars 112A and 112B are for a common frequency band that is different from the band of the band-specific filars 110A and 110B.

In general, the filars 110A, 110B, 112A, 112B may be made of electrically conductive material. The electrically conductive material may be metal, plastic, dried pasta or the like, for example. Thickness of the filars may be such as used in the prior art, for example, because the suitable thickness may vary in a wide range. The length of the filars is related to the frequency bands for which the antenna is designed or assigned. The lengths of the filars may be about $\lambda/4$, $\lambda/2$ or $3\lambda/4$, for example. In general the lengths of the filars may be a multiple of $\lambda/4$, i.e. $n*\lambda/4$, where n is a positive integer (1, 2, 3, . . . ).

The two band-specific filars 112A and 110B, which belong to the different port-specific sets 106, 108 and which are directly adjacent to each other, cause mutual coupling between the ports 102, 104. The mutual coupling is such that it results in a destructive phasing between the two of the band-specific filars 112A, 110B. The mutual coupling may result in an opposite phasing between the two of the band-specific filars 112A, 110B. It can be said that antenna filars are arranged such way that adjacent filar groups are strongly coupled with adjacent ports. Thus, the mutual coupling at least partly prevents the frequency band communicated to or from the port 102 via the filar 112A to enter the port 104.

That is, the cross talk between two adjacent ports 102, 104 is eliminated or reduced by phasing the signals with the filars.

In general, at least two of the directly adjacent band-specific filars 110A, 110B, 112B, 112B, which belong to different port-specific sets 106, 108 of the port-specific sets 106, 108 and different band-specific filars, are configured to cause the mutual coupling of the destructive phasing of the frequency bands between the at least two of the band-specific filars 110B1, 110B2, 112 B1, 112B2.

In an embodiment, the mutual coupling may be based on a shortest distance Df between the two band-specific filars 112A, 110B of the adjacent port-specific sets 106, 108 of the filars. The shortest distance Df, which may be a non-zero distance, i.e. not a galvanic contact, is shorter than a distance Dp between two of the ports 102, 104 directly adjacent to each other divided by the number Nfp of the band-specific filars 110A, 112A of one of the port-specific set 106, 108. In a mathematical form the shortest distance Df is Dp/Nfp. In FIG. 1, the number of the band-specific filars per on port is two. Thus, the distance Df between the mutually coupled filars is shorter than Dp/2.

Figure 7:
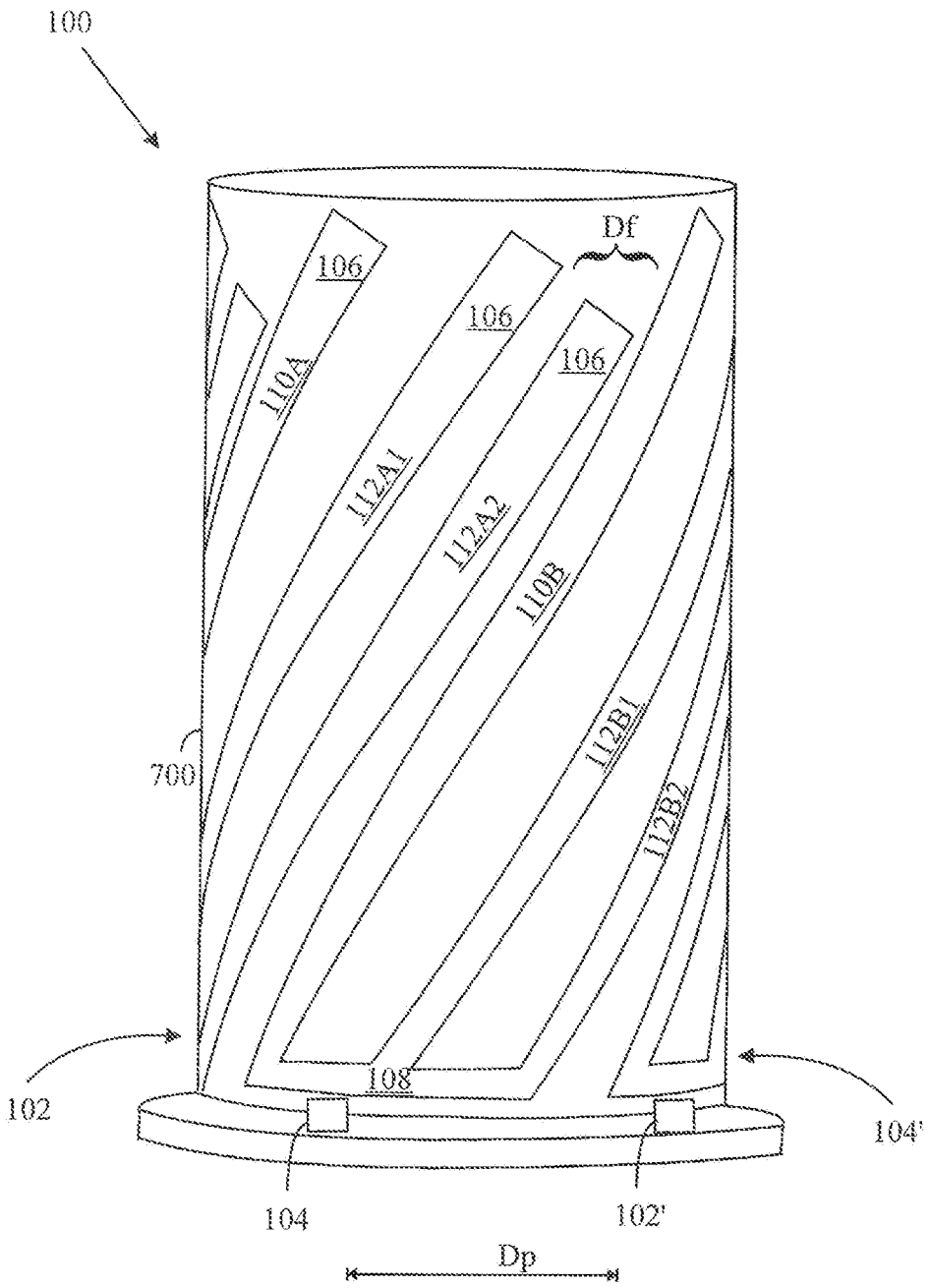
FIG. 7 illustrates a dual band quadrifilar ¼ lambda antenna with a mutual coupling between the ports.

In a general embodiment, the mutual coupling may be based on the shortest and potentially non-zero distance Df between at least two of the band-specific filars 112A, 110B of the adjacent port-specific sets 106, 108 of the filars (see also FIG. 7). The shortest distance Df is shorter than the distance Dp between two of the ports 102, 104 directly adjacent to each other divided by the number Nfp the band-specific filars 110A, 112A of one of the port-specific set 106, 108. The shortest distance Df can be found by experiments (a few tests is enough), simulation or theoretical computations without unbearable burden. In an embodiment, the shortest distance Df between the at least two of the band-specific filars 112A, 110B of the adjacent port-specific sets 106, 108 of the filars may be from an end of one of the at least two of the band-specific filars 112A, 110B of adjacent port-specific sets 106, 108 of filars to another of the at least two of the band-specific filars 112A, 110B of the adjacent port-specific sets 106, 108 of filars.

In an embodiment, the shortest distance Df may from the end of a first filar to a point between the ends of a second filar, where the first filar is shorter than the second filar.

In an embodiment, a distance between the two band-specific filars 112A and 110B, which belong to the different port-specific sets 106, 108 and which are directly adjacent to each other, is at a maximum in vicinity of the ports 102, 104 and at minimum at an opposite end of the at least two of the band-specific filars 112A, 110B of the adjacent port-specific sets 106, 108 of filars.

Figure 2:
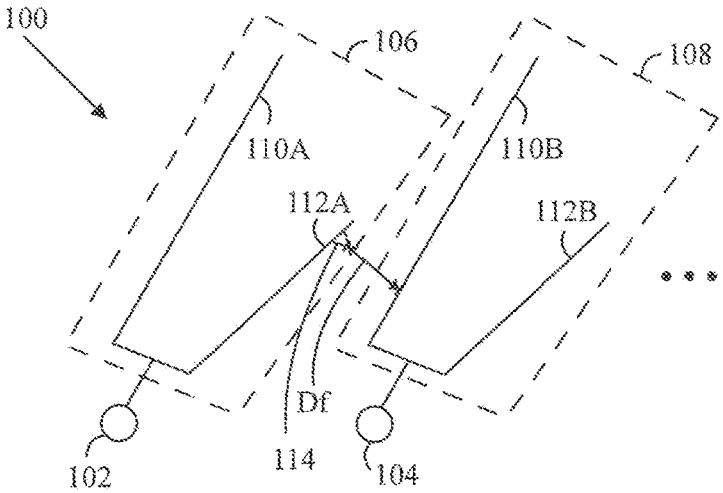
FIG. 2 illustrates an example of the helical antenna which has an extension for the mutual coupling.
Figure 3:
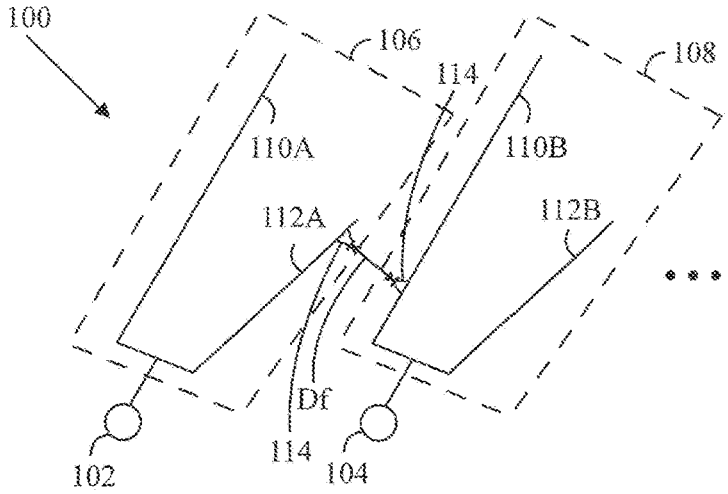
FIG. 3 illustrates an example of the helical antenna which has extensions in filars associated with different ports.

In an embodiment an example which is illustrated in FIGS. 2 and 3, at least one of the at least two of the band-specific filars 112A, 110B of the adjacent port-specific sets 106, 108 of filars may comprise or may be coupled with an extension 114 for the mutual coupling. The extension 114 may be directed towards another of the at least two of the band-specific filars 110B, 112A of the adjacent port-specific sets 106, 108 of filars. The shortest distance Df between the at least two of the band-specific filars 112A, 110B of adjacent port-specific sets 106, 108 of filars may be at the at least one extension 114.

FIG. 2 illustrates an example of where only the filar 112A comprises or is coupled with the extension 114. Correspondingly, only the filar 110B could comprise or be coupled with the extension 114. FIG. 3 illustrates an example where both the filar 112A and the filar 110B comprise or are coupled with their own extensions 114. When a filar comprises the extension 114, the extension 114 may be an integral part of the filar made of the same material as the filar, or the extension 114 may be made in galvanic contact with the filar. When a filar and the extension 114 are coupled with each other, they may have a capacitive or inductive connection therebetween. Naturally, they may also have a galvanic connection therebetween but that would then be the same as the case where the filar comprises the extension 114.

Figure 4:
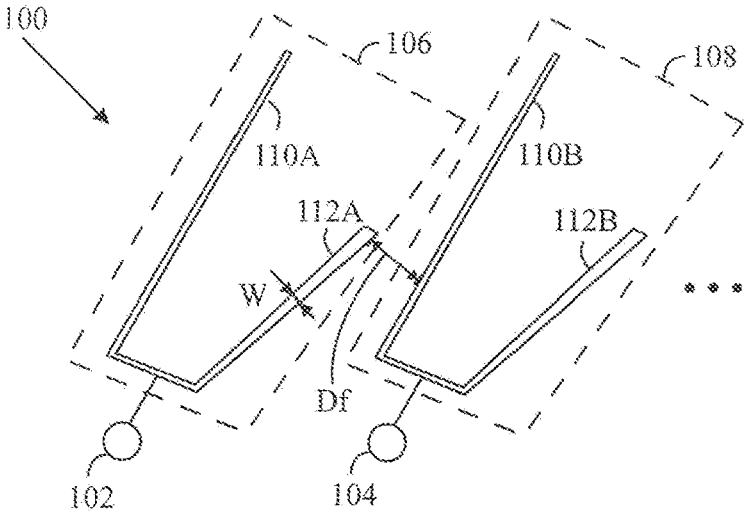
FIG. 4 illustrates an example of the helical antenna which has a varying width in at least one filar.
Figure 5:
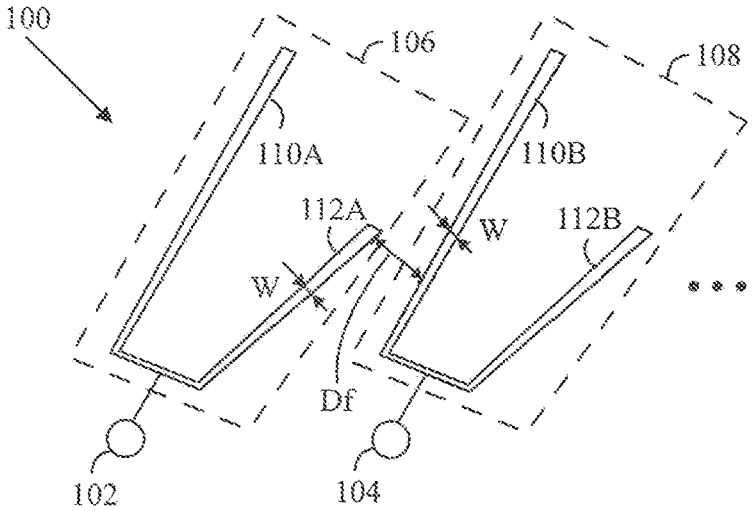
FIG. 5 illustrates an example of the helical antenna which has filars of varying width.

In an embodiment an example which is illustrated in FIGS. 4 and 5, a width W of at least one of the at least two of the band-specific filars 112A, 110B of the adjacent port-specific sets 106, 108 of filars may increase with an increasing distance L along said filar from the port 102, 104 of the port-specific sets 106, 108 of filars it belongs to for the mutual coupling. The changing width W changes a distance Df between the at least two of the band-specific filars 112A, 110B. Typically, the width W may widen with the increasing distance L along said filar from the port 102, 104. When the width of the filar is larger at the end, which is opposite to the end coupled with the port, the operational frequency becomes lower, which, in turn, allows the antenna to be made shorter and more compact because typically a lower operational frequency requires longer filars.

Alternatively or additionally, at least one of the filars 112A, 110B may be bent such that the distance Df is shorter between the filars 112A, 110B at the bending than elsewhere. Still alternatively or additionally, at least one of the filars 112A, 110B may have a bevel such that the distance Df is shorter between the filars 112A, 110B at the bending than elsewhere.

Figure 6:
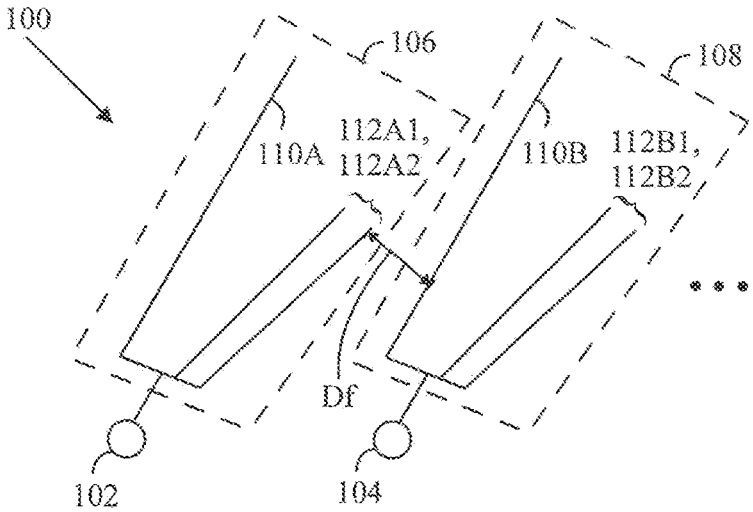
FIG. 6 illustrates an example of the helical antenna which has a plurality of filars of common frequency associated with the same port.

In an embodiment an example which is illustrated in FIG. 6, each of the port-specific sets of filars 106 may comprise at least two band-specific filars 112A1, 112A2 which may have the mutual coupling to another filar 110B of another port-specific sets 108 of filars. In FIG. 6, two filars 112A1, 112A2 of the port 102 are shown be designed to have the mutual coupling with the filar 110B of the adjacent port 104. The shortest distance Df may be considered to be an average of the distances from the filars 112A1 and 112A2 to the filar 110B. The filars 112B1, 112B2 may have a similar mutual coupling with the filars of the next port.

In an embodiment an example which is illustrated in FIG. 7, the apparatus may comprise a dual band quadrifilar ¼ lambda antenna. The quadrifilar antenna has four ports that are phased in a quadrature manner. The fed or received radio frequency signals have an amplification for making the radio frequency signals to have the same amplitude. There may be a 90° phase shift in the input or output radio frequency signal between directly adjacent ports 102, 104, 102', 104'. That is, if the port 102 has a 0° phase, the port 104 has a 90° phase, the port 102' has a 180° phase and the port 104' has a 270° phase.

The electrically conducting antenna filars are on a cylindrical structure 700 which may be made of electrical non-conducting material such as plastic, for example. The port-specific set 106 comprises two band-specific filars 112A1, 112A2 associated with port 102 (the port being behind the cylinder) for a first band, and one band-specific filar 110A for a second band. The two band-specific filars 112A1, 112A2 of each of the port-specific sets 106, 108 for the first band may cause the mutual coupling with the one band-specific filar (110B) of the adjacent port (102, 104).

Each of the port-specific sets 106, 108 comprises two band-specific filars (112A1, 112A2 associated with port 104 in FIG. 7) for a first band, and one band-specific filar (110A associated with port 104 in FIG. 7) for a second band. The two band-specific filars 112A1, 112A2 of each of the port-specific sets 106, 108 for the first band may cause the mutual coupling with the one band-specific filar 110B of the adjacent port 102, 104.

Antenna efficiency may be optimized or improved over wider bandwidth because the mutual coupling is reduced or cancelled by causing the destructive phase shifts to the signals in adjacent filars which belong to different ports.

In this ¼ lambda antenna three filars are used to get excellent reflection loss for each of two operational bands. The ¼-lambda quadrifilar helical antennas have challenges with the mutual coupling between four sets of filars in the prior art. Namely, the mutual coupling usually introduces an extra loss and reduces performance. In the solutions of this application, the mutual coupling is decreased or cancelled by strong coupling of the adjacent ports by mixing sets of filars with ports. One of the three resonant filars 110A belongs to adjacent ports set of filars. This is exceptional and according to the prior art, it is and should be avoided. The ports are strongly coupled together but with a phase that cancels the coupling. Usually coupling between filars is tried to be avoided and seen as extra loss. The coupling between the ports by filars of different frequency bands is used as an advantage.

The multifilar quadrifilar helical antenna with the mutual coupling between the ports may be used as a satellite antenna, satellite positioning system antenna (such as GPS, Glonass etc.), smart phones, rugged phones (tolerates environmental hazards with good or military-grade protection), for example. The helical antenna can be made small in size while keeping a good performance level. The beam can be made purely wide, and polarization can be kept circular.

It will be obvious to a person skilled in the art that, as technology advances, the inventive concept can be implemented in various ways. The invention and its embodiments are not limited to the example embodiments described above but may vary within the scope of the claims.

The invention claimed is:

1. A quadrifilar helical antenna for communicating in a plurality of different frequency bands, and the quadrifilar helical antenna comprises at least two ports;

each port is operationally coupled with a port-specific set of helical filars, the port-specific set of filars including at least one band-specific filar for each of said plurality of the different frequency bands; and at least two of the band-specific filars, the band-specific filars belonging to different band-specific filars and different port-specific sets adjacent to each other, are configured to have mutual coupling between the ports, wherein the mutual coupling is based on a shortest distance between the at least two of the band- specific filars of the adjacent port-specific sets of the filars, said shortest distance being shorter than a distance between two of the ports adjacent to each other divided by the number of the band-specific filars of one of the port-specific set, the mutual coupling being configured to result in a destructive phasing of the frequency bands between the at least two of the band-specific filars.

2. The quadrifilar helical antenna of claim 1, wherein the shortest distance between the at least two of the band-specific filars of the adjacent port-specific sets of filars is from an end of one of the at least two of the band-specific filars of adjacent port-specific sets of filars to another of the at least two of the band-specific filars of adjacent port-specific sets of filars.

3. The quadrifilar helical antenna of claim 1, wherein, for the mutual coupling, at least one of the at least two of the band-specific filars of the adjacent port-specific sets of filars comprises or is coupled with an extension directed towards another of the at least two of the band-specific filars of the adjacent port-specific sets of filars, the shortest distance between the at least two of the band-specific filars of adjacent port-specific sets of filars being at the at least one extension.

4. The quadrifilar helical antenna of claim 1, wherein, for the mutual coupling, a width of at least one of the at least two of the band-specific filars of the adjacent port-specific sets of filars is configured increase with an increasing distance along said filar from the port of the port-specific sets of filars it belongs to.

5. The quadrifilar helical antenna of claim 1, wherein each of the port-specific sets of filars comprises at least two band-specific filars which are configured to couple the band of the filar to another filar of another port-specific sets of filars.

6. The quadrifilar helical antenna of claim 1, wherein the quadrifilar helical antenna comprises a dual band quadrifilar antenna; each of the port-specific sets comprises two band-specific filars for a first band, and one band-specific filar for a second band; and the two band-specific filars of each of the port-specific sets for a first band are configured to cause the mutual coupling with the one band-specific filar the adjacent port.

* * * * *